US009009999B2

(12) United States Patent
Hill

(10) Patent No.: US 9,009,999 B2
(45) Date of Patent: Apr. 21, 2015

(54) SELF CONTAINED INFORMATION DECK

(71) Applicant: Steve Hill, Houston, TX (US)

(72) Inventor: Steve Hill, Houston, TX (US)

(73) Assignee: Steve Hill, Houston, TX (US)

( * ) Notice: Subject to any disclaimer, the term of this patent is extended or adjusted under 35 U.S.C. 154(b) by 0 days.

(21) Appl. No.: 13/672,216

(22) Filed: Nov. 8, 2012

(65) Prior Publication Data

US 2014/0123526 A1 May 8, 2014

Related U.S. Application Data

(60) Provisional application No. 61/560,660, filed on Nov. 16, 2011.

(51) Int. Cl.

| | |
|---|---|
| ***G09F 7/00*** | (2006.01) |
| ***G09F 11/00*** | (2006.01) |
| ***G09F 11/23*** | (2006.01) |

(52) U.S. Cl.

CPC ..... *G09F 11/00* (2013.01); *G09F 11/23* (2013.01)

(58) Field of Classification Search

CPC ..... G09F 7/00; G09F 3/202; G09F 5/04; G09F 11/23; G09F 11/04; A63B 71/0672; B65D 27/00; G06G 1/04

USPC ..... 40/492, 495

See application file for complete search history.

(56) References Cited

U.S. PATENT DOCUMENTS

| | | | | |
|---|---|---|---|---|
| 2,693,648 | A * | 11/1954 | Anderson | 434/153 |
| 3,139,611 | A * | 6/1964 | Paul | 340/321 |

* cited by examiner

*Primary Examiner* — Casandra Davis

(74) *Attorney, Agent, or Firm* — Baker & Hostetler LLP

(57) ABSTRACT

Disclosed herein is a self-contained group of cards or placards rotatable along a common axis. In some aspects said group fits within the boundaries of a fixed front and back wall and a tactile cue is provided on at least one wall to identify front or back. When compiled as a deck, the device has a first cover with an exterior and an interior face, a second cover with an exterior and an interior face wherein the interior of each covers faces the other, a pivot connected to each interior face between; at least one card with a pivot guide where through said pivot extends and around which said card rotates and a finger grab extended from at least one of said first and second covers.

10 Claims, 4 Drawing Sheets

SELF CONTAINED INFORMATION DECK

REFERENCE TO RELATED APPLICATIONS

This application claims the full Paris Convention priority to U.S. provisional application 61/560,660, filed on Nov. 16, 2011, the contents of which are incorporated by this reference, as if fully set forth herein in their entirety.

FIELD

This disclosure relates to a self-contained movable group of placards.

GENERAL BACKGROUND

Information Articles are known in the art; U.S. Pat. No. 3,950,871 illustrates a cassette book.

Having information available in a contained and organized book may be useful for many industries, wherein such information may be operational or educational.

DESCRIPTION

Traditional methods which have been utilized for providing contained or connected informational pages such as those shown in U.S. Pat. No. 3,950,871 lack physical orientation reference.

According to some exemplary implementations, devices, systems, and methods of the present disclosure are directed to a self-contained group of cards or placards rotatable along a common axis. In some aspects, said group fits within the boundaries of a fixed front and back wall and a tactile cue is provided on at least one wall to identify front or back.

According to some exemplary implementations, devices, systems, and methods of the present disclosure are directed to a self-contained group of cards or placards rotatable along a common axis. In some aspects, said group fits within the boundaries of a fixed front and back wall at least one portion of at least one of said front and said back wall is extended to provide a physical cue to proper orientation.

According to some exemplary implementations, devices, systems, and methods of the present disclosure are directed to a self-contained group of interior cards or placards rotatable along a common axis. In some aspects, said group fits within the boundaries of a fixed front and back wall and a wall extension beyond the interior card diameters and outside the rotational pathway of said interior cards forms a finger hold to secure said group of cards or placards, wherein interior cards may be rotated while the user firmly grips the extended corner. Having a firm hand grip may reduce at least one of finger injury, and/or wear and tear on the deck, placards, and the rotational mechanism.

According to some exemplary implementations, devices, systems, and methods to improve a deck of rotatable cards include providing physical cues to position a deck of informational placards in a desired position (i.e. front forward). Whereby a textured surface on at least one side of a deck provides a physical cue for positioning.

According to some exemplary implementations, devices, systems, and methods provide physical cues on a finger grab to position a deck of informational placards in a desired position (i.e. front forward). Whereby a textured surface on at least one side of a deck provides a physical cue for positioning.

According to some exemplary implementations, a finger grab is provided, and is oversized whereby it will extend out of a shirt pocket.

DRAWINGS

The above-mentioned features and objects of the present disclosure will become more apparent with reference to the following description taken in conjunction with the accompanying drawings wherein like reference numerals denote like elements and in which.

FURTHER DESCRIPTION

Figure 1A:
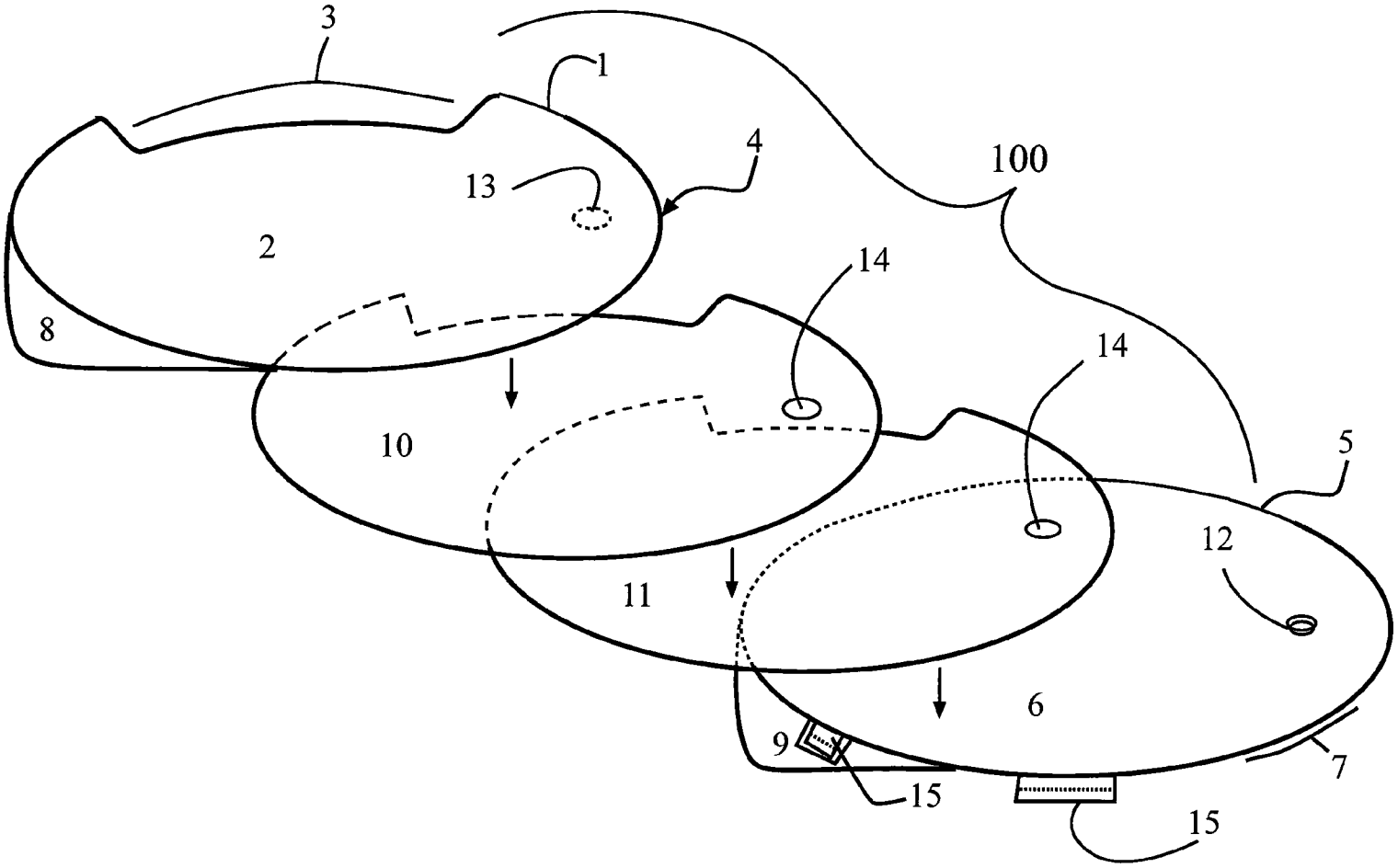
FIG. 1A shows and assembly view of an exemplary implementation of a rotatable deck.

FIG. 1A shows aspects of a rotatable deck 100 and a system and method to provide a gripping surface remote from rotating cards. The deck shown in FIG. 1A is in an exploded assembly view. A deck of rotatable cards is formed. Said deck having a generally ovoid shape. The substantially planar top cover 1 is indicated having a generally ovoid shape and an interior face (not shown) and an exterior face 2 also having a card selection window 3 and a generally ovoid circumference 4; a substantially planar back cover 5 is indicated having a generally ovoid shape and an interior face 6 and exterior face (not shown) and a generally ovoid circumference 7; and, a plurality of generally ovoid cards. Cards (may be referred to herein as pages and placards). Each of said top cover and back cover shown in FIGS. 1A-1C sandwich said cards. To maximize the viewable area of each card the cards are only slightly smaller than the top and back cover.

Figure 1B:
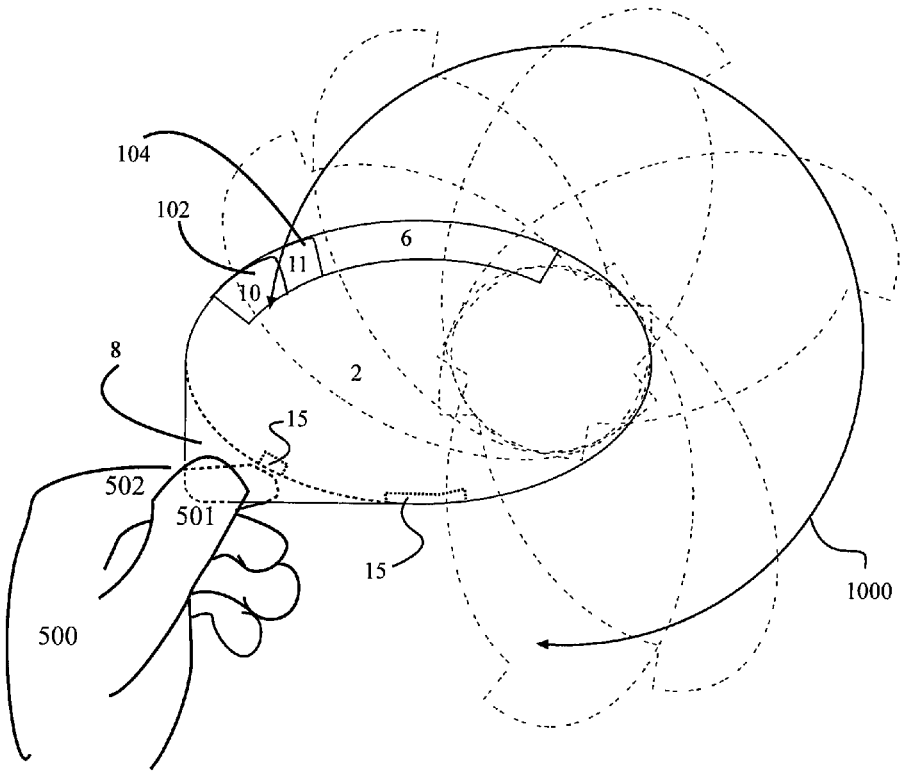
FIG. 1B shows a user holding the rotatable deck of FIG. 1A.

Extended from the top cover 1 is a front finger grab 8. The extended finger grab is extended outside the perimeter of the cards when the deck is closed. The front finger grab 8 is also positioned outside the rotational pathway 1000 of cards as shown in FIG. 1B. Extended from the bottom cover 5 is a back finger grab 9. The extended finger grab is extended outside the perimeter of the rotational pathway 1000 of the cards when the deck is opened or closed. The back finger grab 9 is also positioned outside the rotational pathway of cards as shown in FIG. 1B. Those of ordinary skill in the art will recognize that it is within the scope of this disclosure that either one or both finger grabs may be deployed. Moreover it is also within the scope of the disclosure that said finger grab(s) although generally planar may be out of plane with said top and back cover. Said finger grab(s) may also in some instances be contoured with bumps, divots and bends.

Further the surface of said finger grab(s) may be different than said cover or cards. In some instance the grab surface way be sticky. In some instances a series of raised and coated bumps may be on said finger grab(s). Coatings may include rubberized material or vinyl or tacky. In some instance the grab(s) may be rougher than the exterior surfaces of the covers, in some instances said exterior of the finger grab(s)

may be covered with or include additional layers or covers such as Velcro® foam or the like.

In yet other instances at least one of an edge of a card, a cover or a portion thereof may be mirrored or support a reflective material.

Figure 1C:
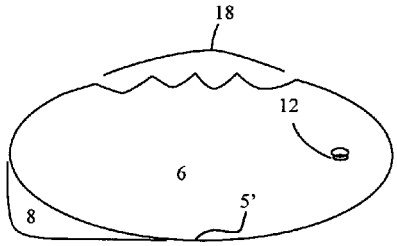
FIG. 1C shows an alternate exemplary cover for a rotatable deck.

FIG. 1C shows aspects of an alternate back cover 5' wherein a back window 18 is formed to provide additional access to the rotatable card.

Rotation is of cards is guided about pivot 12. Pivot 12 may be formed on the interior face 6 of the back 5 or a pivot 13 may be formed on the interior face of the top or on both top and back. Formed in each card is pivot guide 14 where through passes said pivot. At least a portion of the edge at the periphery 4 and 7 of the top and bottom covers can be separated, connected and/or supported via a tab-like wall structure. In the current implementation formed from one of said covers but which those of ordinary skill in the art will understand to include a discreet bridge between each cover also. Adhesive can be used to affix said tab or wall. Tabs 15 are shown extended from said periphery of at least one cover and bent and glued to connect from one cover to another. Such tab and clue assembly devices and methods are known in the art and therefore not described in greater detail.

When the device 100 is assembled and in a closed position a series of sequentially positioned leading edges corresponding to the rotatable cards are viewable through window 3 of the top cover 10. The first card 10 presents grab tab 102 which is in front of the second card 11. The second card presents a grab tab 104

Figure 2A:
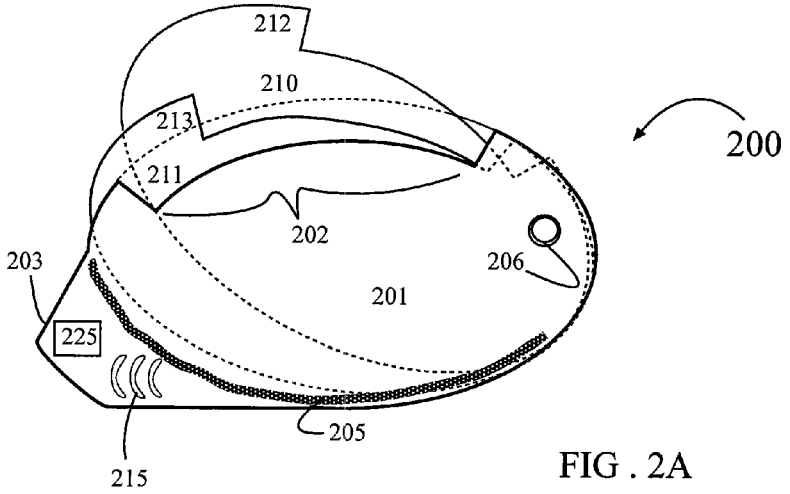
FIGS. 2A-2C show sequential view of an exemplary implementation of a deck with a card rotated into a view orientation.
Figure 2B:
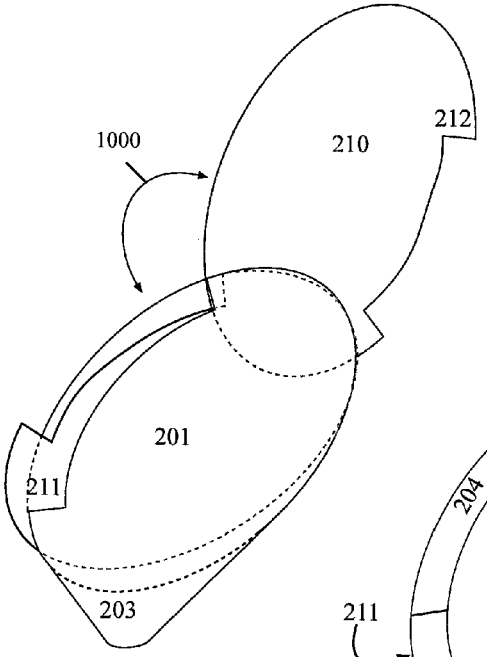
Figure 2C:
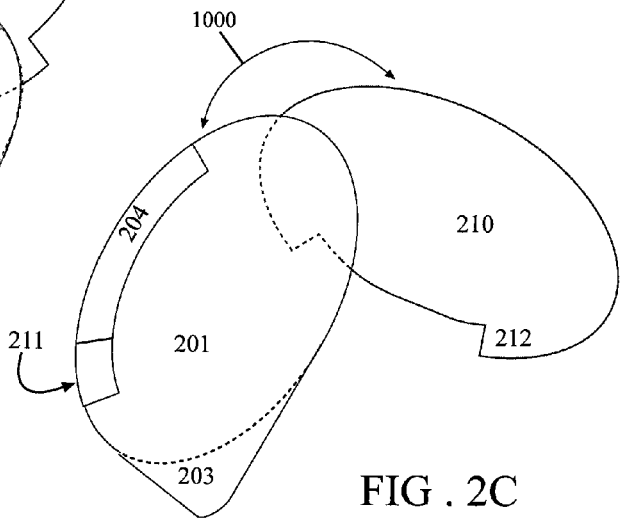

FIGS. 2A-2C show exemplary implementations of a deck with rotatable cards. It is required that the finger grab(s) extend in an orientation which do not interfere with the rotation of the cards from between the covers nor the position of the cards once rotated, nor the viewing of rotated card as shown in FIGS. 2A-2C. In the absence of finger grabs a user would necessarily be required to hold a rotatable deck by applying a force or pressure on the covers, the rotating means, and the cards. Damage to the rotating means or in inability to rotate out cards could prevent efficient use of the deck.

To utilize said finger grab(s), a user's hand 500 clasps the finger grab(s) between at least a thumb 501 and a finger which may include a forefinger 502. The cards are rotated around the pivot generally along the path of line 1000.

Shown in FIGS. 2A-2C are exemplary implementations of a system of rotatable placards 200. A generally planar front cover 201 with a window 202 and a finger grab 203 is affixed to a rear cover 204 via an affixing means at or about a portion of the periphery of the covers (generally within at least a portion of region 205) whereby said affixing means does not interfere with the rotational movement of placards. A rotational support means 206 such as a pivot, bearing, post, or the like is interposed between the interior faces of said front and said rear covers. One or more placards are rotatably mounted to said rotational support means via guides. Placards 210 and 211 are shown in FIGS. 2A-2C. The illustration of two placards is not indicative of the minimum or maximum number of placards within the scope of this disclosure.

Said placards are stacked. To provide for visual identification of each card when the deck 200 is closed each placard has a staged tab. The backmost placard has the tab which extends the greatest length across the window, with the next placard in sequence having a shorter tab and so on. Placard 210 is illustrated as the bottom placard. Tab 212 extended from placard 210 extends a greater length in window 202 than tab visible through window 202. The top placard 211 has tab 213 which is of a shorter length than tab 212. When closed a user can visually see both tab 212 and tab 213 and thereby make a selection. A texture such as raised bump 215, rail and the like, to define a region of the deck, such as the finger grab are illustrated in FIG. 2A.

Those of ordinary skill in the art will recognize that this disclosure also contemplates and teaches the use of divots, slots, holes, wells or other textures upon at least one of a finger grab and a front or back side of a deck, to provide physical positional cues.

Finger grab 203 is shown in FIG. 2A supporting a RFID chip 225. In addition to an RFID, the finger grab may support and or integrate other useful items such as led flashlight with button battery, whistle, reflector, knife (or small cutting blade) and a ruler may be formed on an edge.

Figure 3:
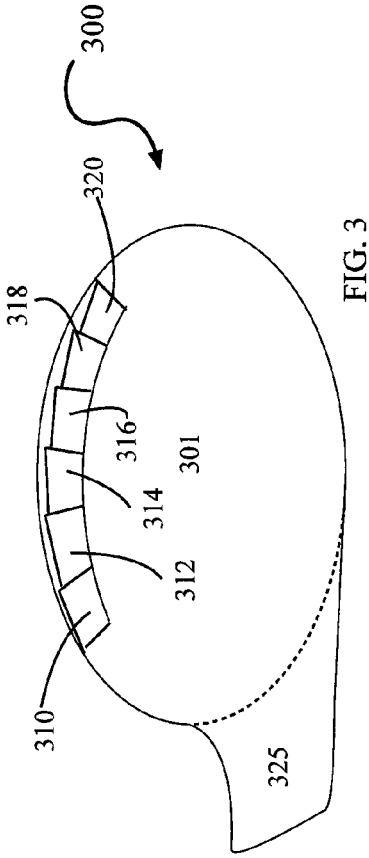
FIG. 3 shows a view of an exemplary implementation of a rotatable deck.

FIG. 3 illustrates an exemplary implantation of a rotatable deck 300. The rotatable deck is formed in generally the same fashion as the previously described exemplary implementations. A series of cards are stored beneath a top cover 301 and a bottom cover (not shown) and a pivoting means is provided between the covers whereby said cards may be rotated out for viewing and rotated back for storing. Tabs 310, 312, 314, 316, 318 and 320 each are extended from a card (cards not shown). A long finger grab 325 is also attached and extended from one or both covers. Said finger grab is oriented to not interfere with movement of said cards. The long finger grab provides a greater surface to hold onto or to support peripheral items such as information, textured surface(s), RFID, reflectors and the like.

Figure 5:
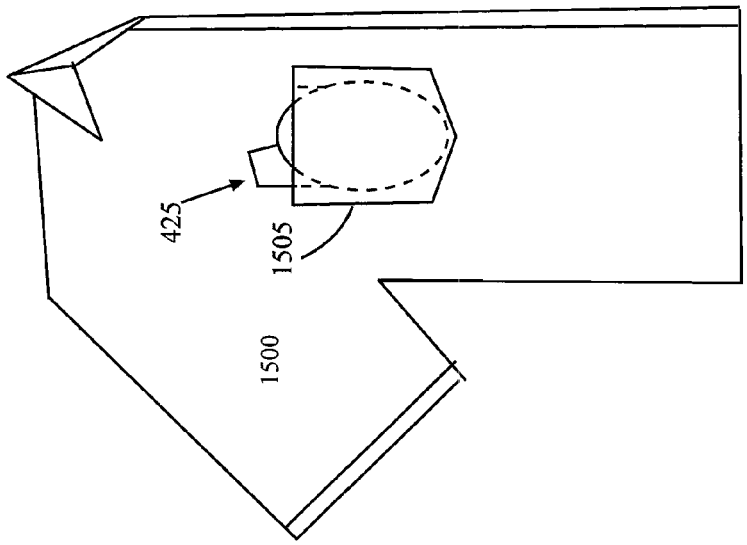
FIG. 5 shows a pocket stored rotatable deck.
Figure 4:
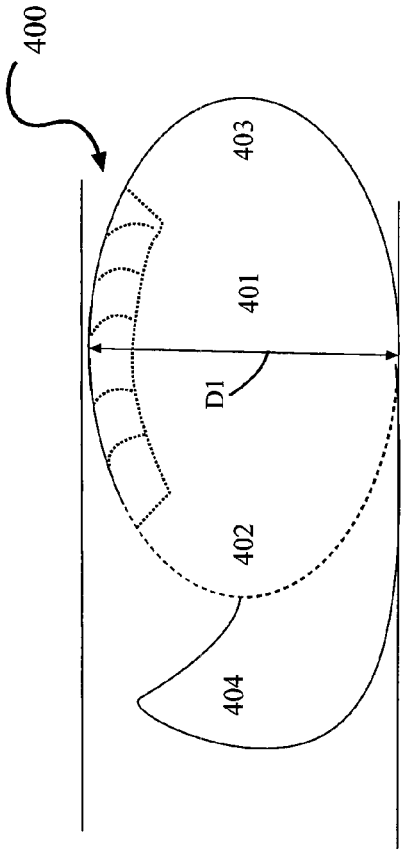
FIG. 4 shows a view of an exemplary implementation of a rotatable deck.

FIG. 4 illustrates an exemplary implantation of a rotatable deck 400. The rotatable deck is formed in generally the same fashion as the previously described exemplary implementations. A series of cards are stored beneath a top cover 401 with a first curved end 402 and a second curved end 403 and a bottom cover (not shown) and a pivoting means is provided between the covers whereby said cards may be rotated out for viewing and rotated back for storing. Tabs are extended from a card (not shown). A large finger grab 404 is also attached and extended from one or both covers. The height diameter D1 of the deck 400 is utilized in this implementation as a limit on the maximum diameter of said finger grab(s). Setting a maximum diameter assure that the deck 400 can fit into a specific size holder such as a shirt 1500 pocket 1505 as shown in FIG. 5 but the extended long finger grab 425 is easily accessible, even with gloves on the hands of the user. Said finger grab is oriented to not interfere with movement of said cards. The long finger grab 425 provides a greater surface to hold onto or to support peripheral items such as information, textured surface(s), RFID, reflectors and the like.

While the method and apparatus have been described in terms of what are presently considered to be the most practical implementations and aspects thereof, it is to be understood that the disclosure need not be limited to the disclosed implementations, aspects or order and/or sequence of combination of aspects. It is intended to cover various modifications and similar arrangements included within the spirit and scope of the claims, the scope of which should be accorded the broadest interpretation so as to encompass all such modifications and similar structures. The present disclosure includes any and all implementations of the following claims.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that as the disclosure relates to elements of the implementation, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this disclosure is entitled.

It should be understood that all actions may be expressed as a means for taking that action or as an element which causes that action.

Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all referenced listed in the Information Disclosure Statement or other information statement filed with the application are hereby appended and hereby incorporated by reference; however, as to each of the above, to the extent that such information or statements incorporated by reference might be considered inconsistent with the patenting, such statements are expressly not to be considered as made by the applicant(s).

In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternatives.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising", are intended to imply the inclusion of a stated element or step or group of elements or steps but not the exclusion of any other element or step or group of elements or steps.

Such terms should be interpreted in their most expansive forms so as to afford the applicant the broadest coverage legally permissible.

All callouts associated with figures are hereby incorporated by this reference.

Since certain changes may be made in the above system, method, process and or apparatus without departing from the scope of the disclosure herein involved, it is intended that all matter contained in the above description, as shown in the accompanying drawing, shall be interpreted in an illustrative, and not a limiting sense.

While various embodiments of the disclosure have been described, it will be apparent to those of ordinary skill in the art that many more embodiments and implementations are possible within the scope of this disclosure. Moreover, it will be understood that the foregoing description of numerous implementations has been presented for purposes of illustration and description. It is not exhaustive and does not limit the claimed disclosures to the precise forms disclosed. Modifications and variations are possible in light of the above description or may be acquired from practicing the disclosure. The claims and their equivalents define the scope of the disclosure. Accordingly, the disclosure is not to be restricted except in light of the attached claims and their equivalents.

The invention claimed is:

1. A deck comprising:

a first generally ovoid cover with an exterior and an interior face;

a second generally ovoid cover with an exterior and an interior face wherein the interior of each covers faces the other;

a pivot connected to each interior face between;

at least one rotatable card with a pivot guide where through said pivot extends;

a rotational pathway (1000) that said rotatable card follows when rotated about the pivot;

a planar finger grab positioned outside of the rotational pathway extended from at least one of said first and second covers; and, wherein the finger grab supports an RFID chip.

2. The deck of claim 1, further comprising:

a window along a portion of at least one cover; and, a tab extended from a portion of each card and positioned to be accessible and visible through said window.

3. The deck of claim 1, further comprising at least one of raised bumps and raised rails on the finger grab.

4. The deck of claim 3, wherein said texture is at least one of rubberized, sticky, vinyl, or tacky.

5. A deck comprising:

a top cover with a generally ovoid periphery an exterior and an interior face;

a rear cover with a generally ovoid periphery an exterior and an interior face wherein the interior of each covers faces each other;

a rotational support means affixed between each interior face between;

at least one generally oval card with a pivot guide where through said rotational support means extends;

a rotational pathway whereby said at least one card moves during operation;

a substantially solid planar finger grab extended outside of the rotational pathway from at least one of said first and second covers; and wherein the finger grab supports an RFID chip.

6. The deck of claim 5, further comprising:

a window along a portion of at least one cover; and, a tab extended from a portion of each card and positioned to be accessible and visible through said window.

7. The method of claim 6, wherein the texture is at least one texture of rubberized, sticky, vinyl or tacky.

8. The deck of claim 5, further comprising a texture consisting of at least one of raised bumps and raised rails on the figure grab.

9. The deck of claim 5, further comprising a texture consisting of at least one of wells, divots and slots on the finger grab.

10. The deck of claim 8, further comprising said texture is at least one of rubberized, sticky, vinyl or tacky.

* * * * *